US005178910A

United States Patent [19]

Reale

[11] Patent Number: 5,178,910

[45] Date of Patent: Jan. 12, 1993

[54] METHOD OF COATING MESH PARTS

[75] Inventor: Louis Reale, Webster, N.Y.

[73] Assignee: Xerox Corporation, Stamford, Conn.

[21] Appl. No.: 753,126

[22] Filed: Aug. 29, 1991

[51] Int. Cl.[5] ..... B05D 5/00; B05D 1/02

[52] U.S. Cl. ..... 427/243; 427/421; 427/425; 118/500; 118/503

[58] Field of Search ..... 427/421, 424, 425, 243; 118/500, 503

[56] References Cited

U.S. PATENT DOCUMENTS

| | | | |
|---|---|---|---|
| 998,952 | 7/1911 | Boone . | |
| 1,945,572 | 2/1934 | Sandbrook | 118/503 |
| 2,184,153 | 12/1939 | Schwartz | 91/68 |
| 2,952,351 | 9/1960 | Stone | 198/177 |
| 3,306,426 | 2/1967 | Arnold et al. | 198/33 |
| 4,646,196 | 2/1987 | Reale | 361/230 |
| 4,900,580 | 2/1990 | Grah et al. | 427/33 |
| 4,920,266 | 4/1990 | Reale | 250/324 |

*Primary Examiner*—Shrive Beck
*Assistant Examiner*—Katherine A. Bareford
*Attorney, Agent, or Firm*—Finnegan, Henderson, Farabow, Garret & Dunner

[57] ABSTRACT

An apparatus and a method for efficiently spray coating mesh parts with a spray gun comprising; a plurality of racks for holding a plurality of mesh parts; and a stand for arranging the plurality of racks in a plurality of positions such that in at least one of the plurality of positions each side of each mesh part directly faces the spray gun, and in at least one of the plurality of positions each side of each mesh part indirectly faces the spray gun.

6 Claims, 7 Drawing Sheets

METHOD OF COATING MESH PARTS

BACKGROUND OF THE INVENTION

1. Field of the Invention

This invention relates to coating methods and apparatus. More particularly, it concerns a rack for supporting work pieces, such as screens in which the surfaces to be coated are interrupted by a high percentage of open area, as well as to a coating method using the rack.

2. Description of the Related Art

In the coating of screens or screen-like objects, the efficiency of coating becomes increasingly important as the cost of the coating material increases. One example occurs in the electrostatic photocopying art, in which scorotrons or other corona charging devices are used to charge or precharge photoreceptors. A negative precharging is used to neutralize the positive charge remaining on the photoreceptor after transfer of the developed toner image to a copy sheet and during cleaning to prepare the photoreceptor for the next copying cycle.

Certain difficulties have been observed to result from such a process. For example, it is believed that various nitrogen oxide species are produced by the corona and that these nitrogen oxide species are adsorbed by solid surfaces. In particular, it is believed that these nitrogen oxide species are adsorbed by the conductive elements as well as the housing of the corona generating device.

When a photocopying machine is turned off for extended periods of idleness, the adsorbed nitrogen oxide species are gradually desorbed. That is, the adsorption is a physically reversible process The adsorbed and desorbed species are both nitrogenous but are not necessarily the same, i.e., for example, there may be some conversion of $NO_x$ to $HNO_3$. When operation of the machine is resumed, a copy quality defect is observed in the copies produced in that a line image deletion or lower density image is formed across the width of the photoreceptor at that portion of the surface of the photoreceptor which was at rest opposite the corona generating device during the period of idleness.

In a particular solution to this problem, as discussed in U.S. Pat. No. 4,920,266 issued to Reale, the screen of the corona generating device is coated with a substantially continuous thin conductive dry film of aluminum hydroxide containing particulate graphite and powdered nickel to inhibit adsorption of the nitrogen oxide species. These coating materials tend to be very expensive.

Scorotron grids must be given a substantially continuous coating of such materials to assure that they will function properly and must have opposite ends, which are masked during the coating process, that remain uncoated to form a good electrical contact with the photocopying device.

One conventional method of coating scorotron grids comprises a rack which includes a rectangular frame suspended by a pair of hooks and having four rectangular openings. Metal plates are pivotally connected to the frame at opposite sides of the openings by hinges. The metal plates are clamped against the front of the frame by a plurality of toggle clamps. The toggle clamps are mounted to the frame in a manner to securely press the plates against the frame.

In the conventional method of spray coating a scorotron grid using the rack described above, sheets of scorotron grids are placed against the rack with their ends disposed between the metal plates and the frame The toggle clamps are closed to pinch each sheet of scorotron grids between the plates and the frame such that each sheet of scorotron grids is thus secured to the rack. The plates also serve the purpose of masking the ends of the scorotron grids so that the ends of the grids are not spray coated.

The rack, with the sheets of scorotron grids attached, is then hung by the hooks from a rod, pipe, or similar hanging means, with a front side of the rack facing a spray gun, for example. The scorotron grids are then sprayed moving the spray gun along the length of a first scorotron grid on the sheet, moving the gun to the next scorotron grid, and then moving the gun along the length of the new grid.

When all of the scorotron grids have been coated, the rack is removed from the hanging means, rotated 180° around a vertical axis, and hung by the hooks from the hanging means such that a back side of the rack opposite the front side now faces the spray ray gun. The back side of the scorotron grids, now facing the spray gun, is sprayed in the same manner as described above with respect to the spraying of the front side of the grids.

The rack is then removed from the hanging means, and the toggle clamps are opened, thereby releasing the sheets of scorotron grids from the rack.

The conventional device and method for spray coating mesh or screen parts such as scorotron grids have suffered from a series of problems. Since a large portion of the parts are open area, 70% or more in many cases, a large amount of spray coating material is wasted when it passes through the open areas of parts, thereby making the process of spray coating very inefficient and wasteful. Since the spray coating material used on the scorotron is expensive, the process is economically inefficient. Also, the coatings produced by the conventional methods often are not substantially continuous near the open areas, or holes, in the parts. When the coating is not substantially continuous, the parts must be resprayed, thereby creating more waste and inefficiency.

Additional problems with quality and efficiency arise because, over time, the spray coating adheres to the toggle clamps and hinges, making them stick and become difficult to open and close. This "sticking" slows the process, thereby making it more inefficient, and causes difficulties in achieving a proper masking on the ends of the scorotron grids since the plates do not then close tight against the rack.

An alternative conventional method of spray coating mesh or screen parts is electrostatic spraying. However, in applications such as spray coating scorotron grids which have a large percentage of open area but have small holes, 3 mm for example, the electrostatic spraying fails to coat the parts adequately because the electric field lines fail to penetrate the small holes in the grid. Also, special safety equipment concerns, when spraying conductive waterbase coatings, add to the process difficulties.

SUMMARY OF THE INVENTION

The present invention has been made in view of the above circumstances and has as an object to provide an apparatus and an improved method for spray coating mesh or screen parts. Hereinafter, the word "mesh" will be used to include "screen" or "grid".

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an apparatus for coating mesh parts comprises a plurality of rack means for holding a plurality of mesh parts, and an arranging means for arranging the plurality of rack means in a plurality of positions such that in at least one of the plurality of positions each side of each mesh part directly faces the spraying means and in at least one of the plurality of positions each side of each mesh part indirectly faces the spraying means.

A related method comprises the steps of attaching a plurality of mesh parts to a plurality of racks; arranging the plurality of racks into pairs, wherein the first side of each mesh part faces away from a mesh part attached to the corresponding rack in the pair and the second side of each mesh part faces toward a mesh part in the corresponding rack in the pair; spraying the plurality of mesh parts with a coating material such that the first side of each mesh part in each rack is directly sprayed with coating material and the second side of each mesh part in each rack is simultaneously coated with overspray when the first side of mesh parts in the corresponding rack in the pair is sprayed; rearranging the plurality of racks into new pairs such that the second side of each mesh part in each rack faces away from the mesh parts in the corresponding rack in the pair and the first side of each mesh part in each rack faces toward the mesh parts in the corresponding rack in the pair; and spraying the plurality of mesh parts with a coating material such that the second side of each mesh part is directly sprayed with the coating material and the first side of each corresponding mesh part is simultaneously sprayed with overspray.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DETAILED DESCRIPTION OF THE PREFERRED EMBODIMENTS

Figure 1:
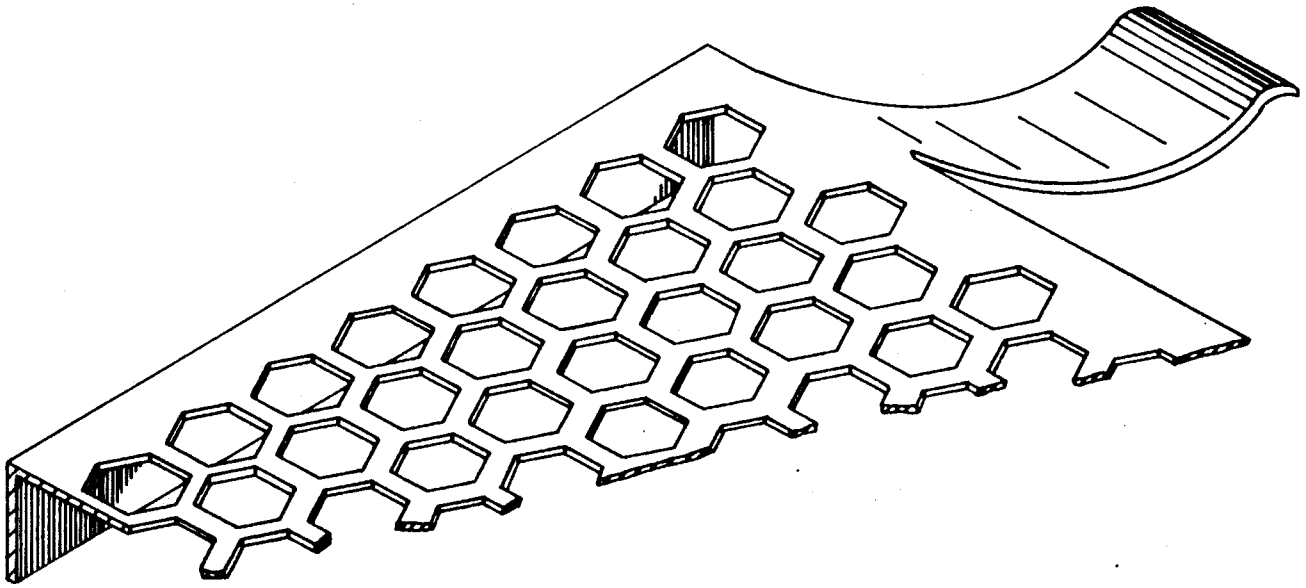
FIG. 1 is an enlarged view of a control grid of a scorotron to be coated using the present invention.

Reference will now be made to the presently preferred apparatus and method incorporating the invention as illustrated in the accompanying drawings, in which like reference characters designate like or corresponding parts throughout the several drawings.

In FIG. 1 of the drawings, a scorotron grid fragment 64 is shown and represents a specific mesh part to be coated using the method and apparatus of the present invention. Such grids contain a high percentage of open area, require coating of both major surfaces as well as edge surfaces defined by openings, and some are relatively delicate or "flimsy", thus requiring support of at least both opposite ends during coating.

Figure 3:
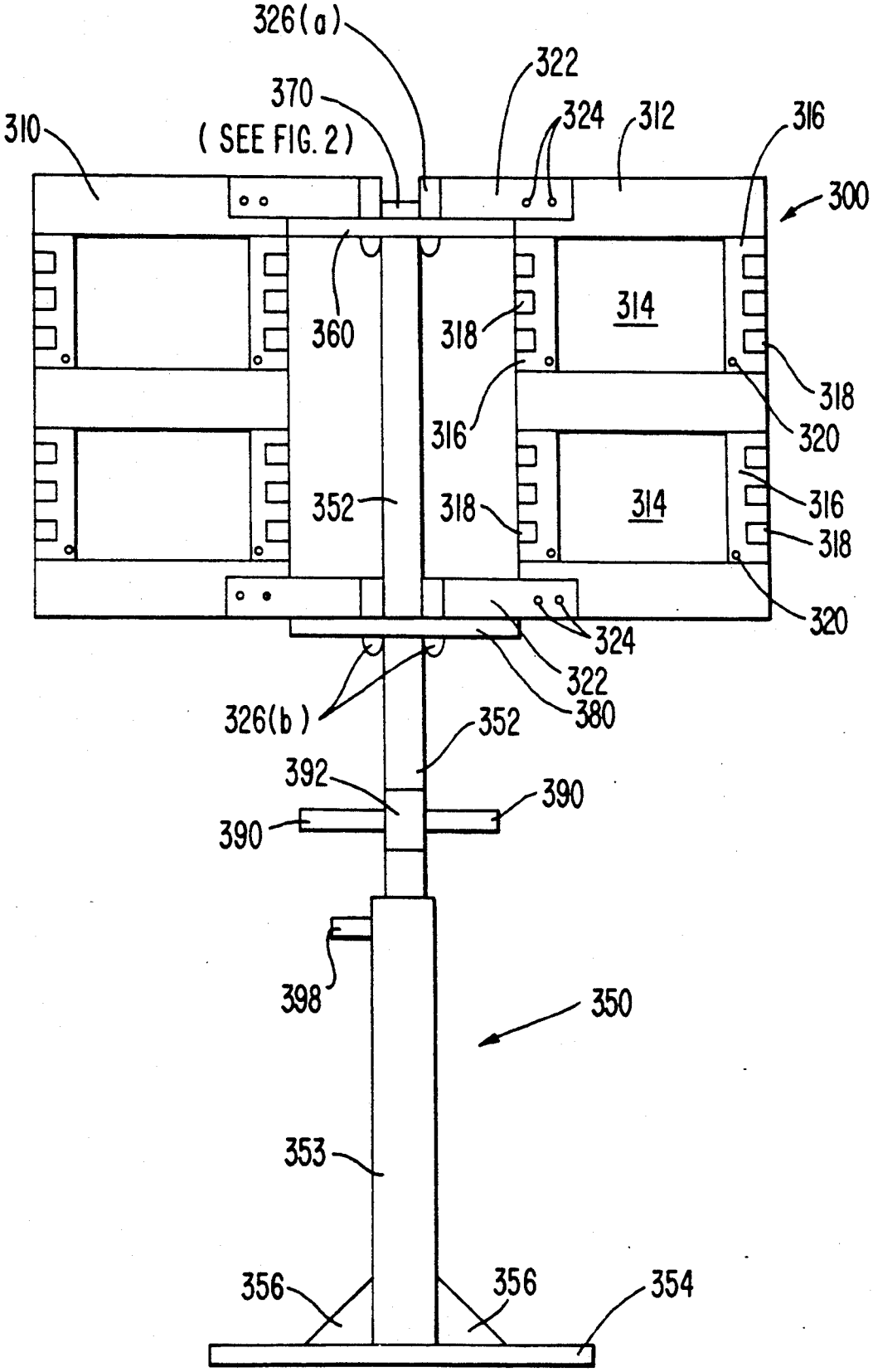
FIG. 3 is a front view of the apparatus of the present invention.

As shown in FIG. 3, there is provided an apparatus 300 for positioning a plurality of mesh parts, including a plurality of rack means and an arranging means. Each of the racks 310 comprise a metal rectangular frame 312 having two rectangular window-like openings 314 within its borders. Along each vertical side of each opening 314 a hinge 318 having a masking plate 316 and a mounting plate 410 (see FIG. 4) is connected to the frame 312. The hinges 318 are secured to the frame 312 by removeable screws (not shown). A cylindrical metal handle 320 is attached to each plate 316. The handles 320 are used to open the plates 316 away from the frame 312.

The arranging means includes braces 322 and bits 326(*a*) and (*b*). Each of braces 322 is attached at one end to the frame 312 with screws 324 at the upper and lower corners of one side of the frame 312. The bits 326(*a*) and (*b*) are attached to the opposite ends of braces 322. The bits 326(*a*) and (*b*) are cylindrical in form with the lower end of each bit being rounded to ease connection to the stand 350, described below, which is also part of the arranging means.

Figure 4:
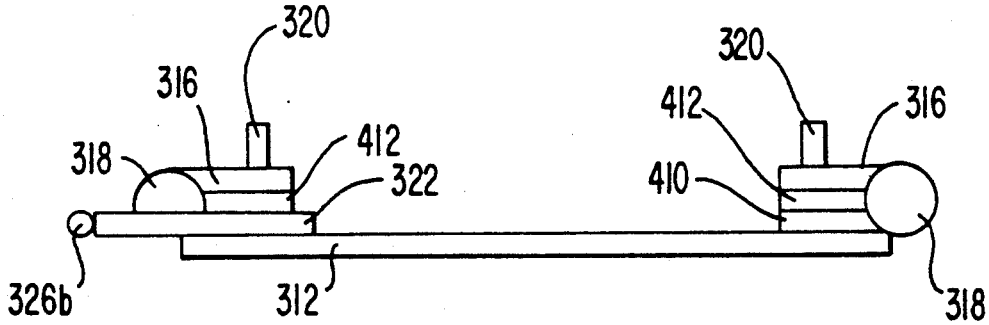
FIG. 4 is a bottom view of a rack shown in FIG. 3.

As shown in FIG. 4, a magnetic strip 412 is attached to each masking plate 316 with an adhesive such that the magnetic strip 412 is sandwiched between the masking plate 316 and the mounting plate 410 of the hinge 318. When a masking plate 316 is closed, the magnetic attraction between the magnetic strip 412 and the mounting plate 410 clamps the magnetic strip tightly against the mounting plate 410 such that the masking plate 316, to which magnetic strip 412 is secured, will remain closed against the mounting plate 410 until a force is exerted on the handle 320 to open the masking plate 316 away from the mounting plate 410.

Figure 2:
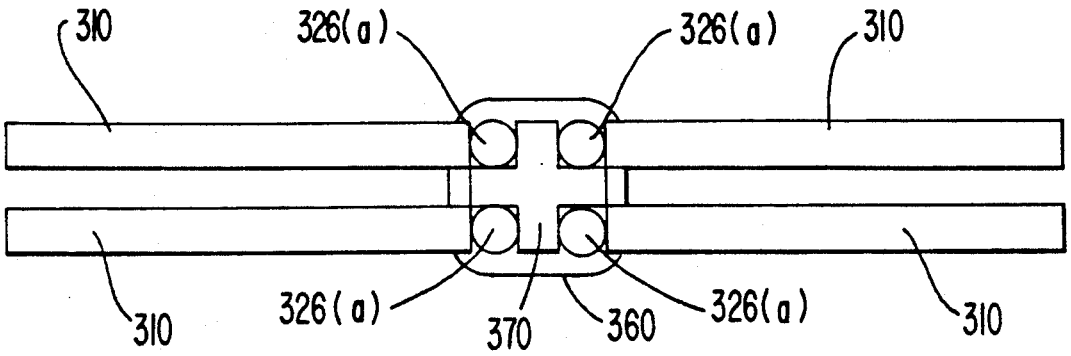
FIG. 2 is a top view of the apparatus of the present invention.

The arranging means also includes a stand 350 to which four racks 310 may be attached, as illustrated in FIGS. 2 and 3. The stand includes two cylindrical portions, a stem 352 and a lower tubular stem 353. The stem 352 has an outer diameter slightly smaller than the inner diameter of lower tubular stem 353 such that a portion of stem 352 slides inside the lower tubular stem 353 and may be rotated inside the lower tubular stem 353 with little friction. The lower tubular stem 353 is connected to a base 354 and a plurality of supports 356 which hold the lower stem 353 in a vertical position.

Figure 5:
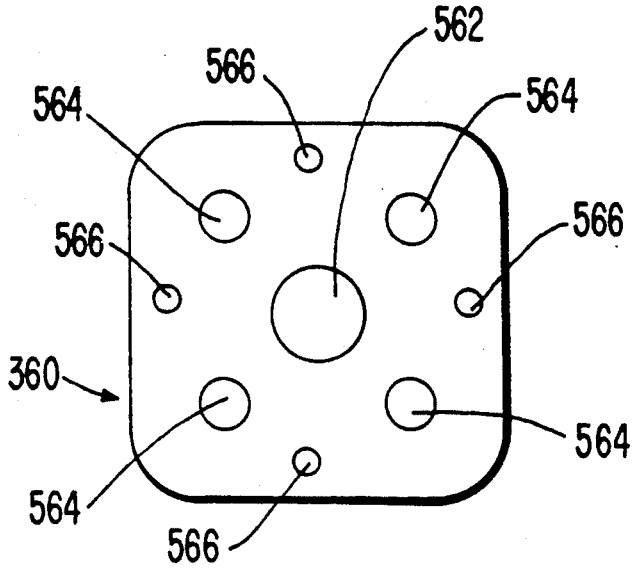
FIG. 5 is a top view of the top metal plate of the stand shown in FIG. 3.

Further, in the arranging means, the plate 360, shown in detail in FIG. 5, is securely mounted on the top of stem 352, which fits tightly into a central hole 562 of the plate 360. The plate 360 has four symmetrically eccentric bit holes 564, having diameters slightly larger than bit 326(*a*) of the rack 310, and arranged in a square pattern as shown in FIG. 5. The plate 360 also has four smaller threaded holes 566 arranged in a square pattern rotated 45 degrees from the pattern of the bit holes 564. The threaded holes 566 are provided so that the alignment tool 370, shown in FIGS. 2 and 3, can be mounted on top of the plate 360 by screws (not shown) fitting through mounting holes in the alignment tool and screwing into the threaded holes 566 of plate 360. The alignment tool aids a user in aligning a bit 326(*a*) with a bit hole 564 so that the bit 326(*a*) may be easily and quickly dropped into the bit hole 564 when the user in placing a rack 310 onto the stand 350.

Figure 6:
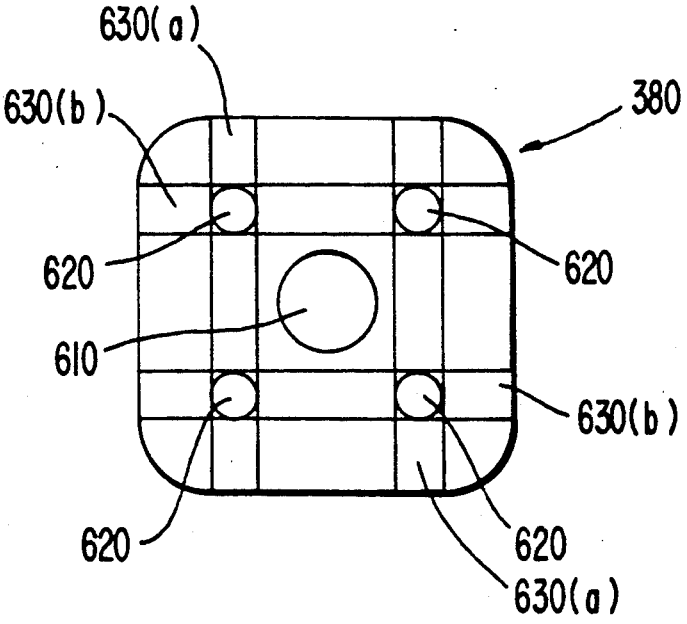
FIG. 6 is a top view of the lower metal plate of the stand of FIG. 3.

A second plate 380, a top view of which is shown in Fig. 6, is mounted in the arranging means on the stem 352 at a point on the stem 352 between the plate 360 and the lower stem 353. As shown in FIG. 6, the plate 380 has a center mounting hole 610 which fits tightly around the stem 352, four bit holes 620 into which a bit 326(*b*) of a rack 310 will be placed, and four grooves 630(*a*) and (*b*).

Two handles 390 are fastened to the stem 352 by a collar 392 located between the plate 380 and the lower stem 353. The handles 390 are used to rotate the stem 352 within the lower stem 353. A set screw 398 is screwed through a threaded hole (not shown) in lower tubular stem 353 thereby preventing rotation of the stem 352 in lower stem 353 when it is tightened. In this manner, the stem 352 may be easily rotated in lower stem 353 by a user when the screw 398 is loosened, but the stem 352 will not rotate due to the force of the spray against the racks 310 when the screw 398 is tightened.

FIG. 2 is a top view of the apparatus illustrated in FIG. 3. Four racks 310 are mounted onto stem 352 such that the upper bits 326(*a*) of the racks 310 protrude through the bit holes 564 in plate 360 and the lower bits 326(*b*) of the racks 310 protrude through the bit holes 620 in plate 380.

As shown in FIG. 2, the four racks 310 are aligned in a substantially parallel fashion such that all of the racks 310 have their lower supports 322 (FIG. 3) aligned in a groove 630(*a*) (FIG. 6) of plate 380 or all of the racks 310 have their lower supports 322 aligned in a groove 630(*b*) of plate 380.

Figure 7:
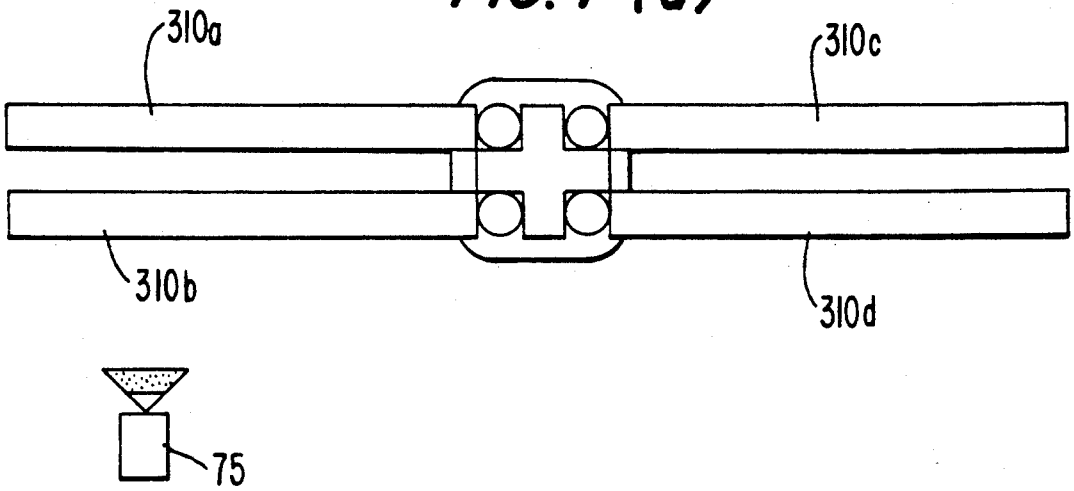
FIGS. 7(*a*), (*b*), (*c*), (*d*), (*e*), and (*f*) are top views of the apparatus of FIG. 3 illustrating the method of the present invention.
Figure 7B:
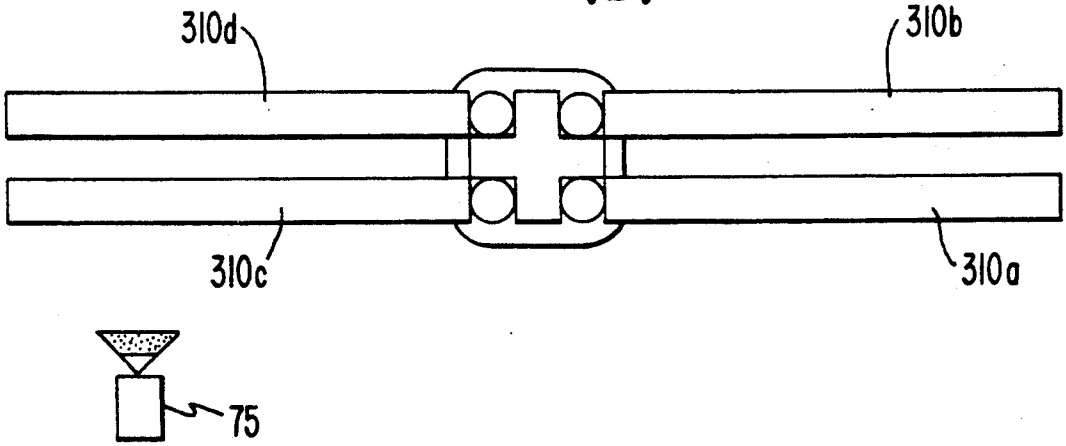
Figure 7C:
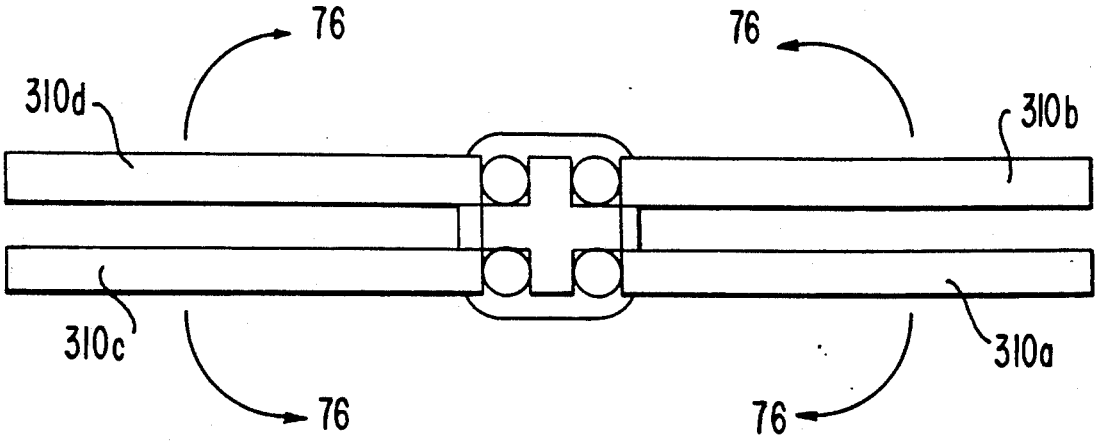
Figure 7:
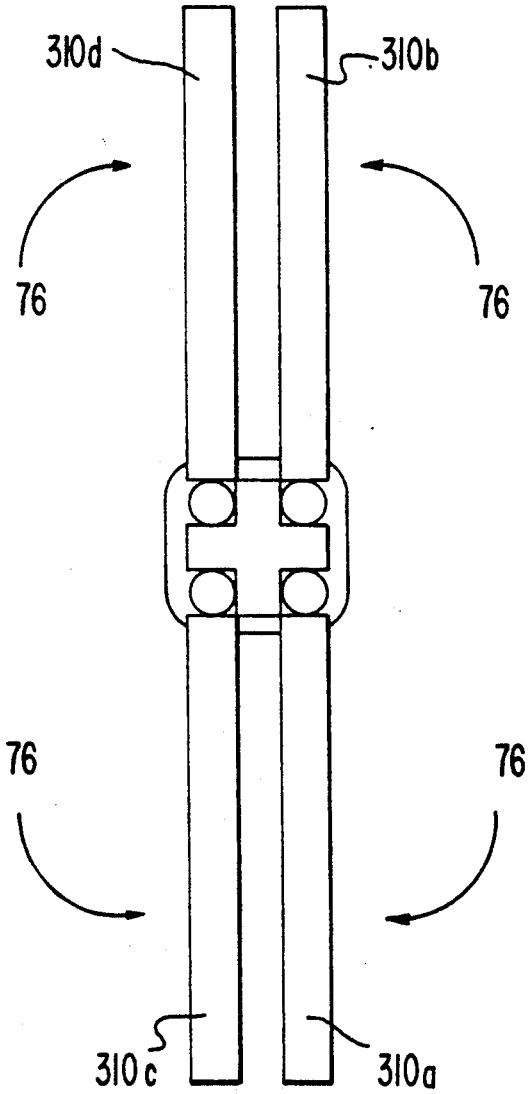
Figure 7E:
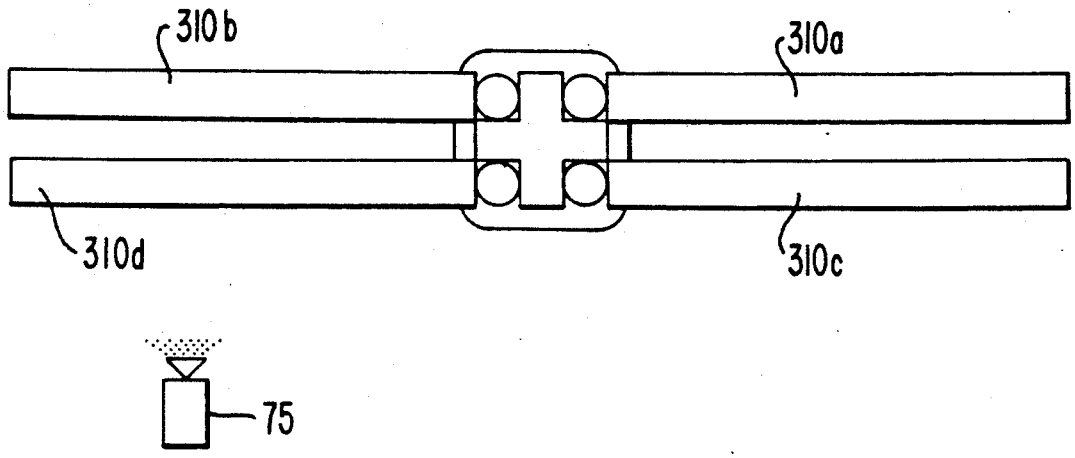
Figure 7F:
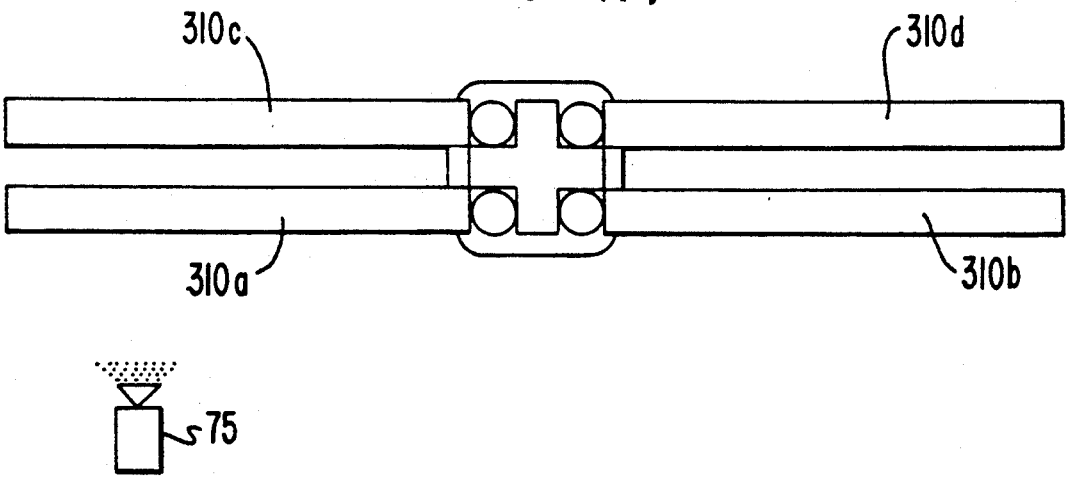

The method of the preferred embodiment will now be described with reference to FIGS. 7(*a*), (*b*), (*c*), (*d*), (*e*), and (*f*). For ease of description, the four racks 310 shown in FIGS. 2 and 3 are distinguished from each other by letter suffixes, i.e., 310*a*–310*d* and are arranged as shown in FIG. 7(*a*) with their lower supports 322 in grooves 630(*a*) of plate 380, such that racks 310*a* and 310*b* form a pair and racks 310*c* and 310*d* form a pair. In such an arrangement, the scorotron grids, exemplified by the grid in FIG. 1, each having first and second sides, are held by the racks such that the first side of each grid faces away from the corresponding rack in the pair and the second side of each grid faces toward the corresponding rack in the pair. Thus, the first side of each grid attached to racks 310*b* and 310*d* faces the spray gun 75 and the second side of each grid attached to racks 310*a* and 310*c* is directly behind racks 310*b* and 310*d*. The first side of the scorotron grids attached to the racks 310*b* and 310*d* are sprayed starting at the left end of the topmost grid on rack 310*b*, moving horizontally to the right end of that grid, moving the gun vertically down to the next adjacent grid on rack 310*b*, and moving the gun to the left end of that grid. The grids on rack 310*b* are thus sprayed in a serpentine fashion and the grids on rack 310*d* are sprayed in a similar manner after completing the grids on rack 310*b*. Since racks 310*a* and 310*c* are directly behind the racks 310*b* and 310*d*, a second side of each of the grids attached to racks 310*a* and 310*c* facing the racks 310*b* and 310*d* are coated, or partially coated, with the overspray passing through the grids attached to racks 310*b* and 310*d*.

Upon completion of the direct spraying of the first side of racks 310*b* and 310*d*, the apparatus is rotated 180° about the stem 352, or the sprayer 75 is moved to the other side of the apparatus 300, such that the racks are now arranged as shown in FIG. 7(*b*), with the first side of the grids attached to racks 310*c* and 310*a* directly facing the spray gun 75, and the racks 310*d* and 310*b* being directly behind racks 310*c* and 310*a*, respectively, with the second side of racks 310*d* and 310*b* facing the racks 310*c* and 310*a*. The first side of each grid attached to racks 310*c* and 310*a* is sprayed in the serpentine manner described with respect to the spraying of the first side of the grids attached to racks 310*b* and 310*d*, with the second side of each grid attached to racks 310*d* and 310*b* being coated with the overspray passing through the grids on racks 310*c* and 310*a*.

The arrangement of the racks is now adjusted as shown in FIGS. 7(*c*) and (*d*) to switch the pairing of the racks. Each of the four racks 310*a*–*d* is rotated 90° about bits 326(*a*) and (*b*) in the directions indicated by the corresponding arrows 76 in FIGS. 7(*c*) and (*d*), to rest the supports 322 of each rack in a groove 630(*b*) of plate 380, such that racks 310*a* and 310*c* form a pair and racks 310*b* and 310*d* form a pair. The entire apparatus is then rotated 90° about the stem 352 to achieve the arrangement shown in FIG. 7(*e*).

In this arrangement, the second side of in rack 310*d* and the second side of grids in rack 310*c*, which were previously indirectly coated by the overspray, now directly face the spray gun for the first time, and the first side of grids in rack 310*b* and the first side of grids in rack 310*a* now face racks 310*d* and 310*c*. Grids in racks 310*d* and 310*c* are sprayed in the serpentine manner described above. In this manner, the second side of grids in rack 310*d* and the second side of mesh parts in rack 310*c* are directly sprayed, and the first side of grids in rack 310*b* and the first side of grids in rack 310*a* each receive an indirect coating from the overspray.

The entire arrangement is now rotated 180° about the 352, or the sprayer is moved to the other side of the apparatus, so that the second side of the grids in rack 310*a* and the second side of the grids in rack 310*b* now directly face the spray gun as shown in FIG. 7(*f*), and are sprayed in the serpentine manner described above, with the first side of the grids in rack 310*c* and the first side of the grids in rack 310*d* receiving an indirect coating from the overspray.

Upon completion of the spraying, the scorotron grids are removed from the racks, new grids are attached, and the process is repeated.

By use of the method of this invention, each of the scorotron grids receives two coats of coating material, aluminum hydroxide containing particulate graphite and powdered nickel, while using the same amount or less spray coating material than used to achieve one coat by conventional methods. Since the grids each receive two coats, one direct and one indirect, each coat applied can be thinner than that of the conventional methods, while the continuity of the coating on the grids is improved due to the application of the second indirect coat. Thus, the efficiency of the process can be improved while adding the benefit of coating with two thin coats rather than one thick coat with little, if any, increase in labor.

The above described apparatus and method are only one application of the present invention. The apparatus may be constructed and the method carried out such that two or eight racks may be used rather than the four described in the preferred embodiment. The groves 630(*a*) and 630(*b*) in plate 380 represent only one means of holding the racks in their arranged positions. In general, the switching of pairing of racks need not require 90° rotations, and may be, for example, respective rotations of 0° and 180° to bring two racks into alignment. Furthermore, the apparatus and method of the present invention may be used in connection with coating many different types of mesh or screen parts in addition to the scorotron grids described above, as well as with many different types of coating materials.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method of spray coating a plurality of mesh parts having first and second sides, comprising the steps of:

arranging said plurality of mesh parts into pairs such that the first side of each mesh part in each pair faces away from the corresponding mesh part in that pair and the second side of each mesh part faces toward the corresponding mesh part in that pair;

spraying said plurality of mesh parts with a coating material such that the first side of each mesh part in each pair is directly coated with the coating material and the second side of each mesh part is simultaneously coated with overspray when first side of the corresponding mesh part in the pair is sprayed;

rearranging said plurality of mesh parts into new pairs such that the second side of each mesh part in each pair faces away from the corresponding mesh part in that pair and the first side of each mesh part faces in each pair faces toward the corresponding mesh part in that pair;

spraying said plurality of mesh parts with a coating material such that the second side of each mesh part is directly coated with the coating material and the first side of each corresponding mesh part is simultaneously coated with overspray when the second side of the corresponding mesh part in the pair is sprayed.

2. A method of spray coating a plurality of mesh parts having first and second sides according to claim 1, wherein the step of arranging said plurality of mesh parts comprises the steps of:

attaching said mesh parts to a plurality of rack means; and rotatably mounting said plurality of racks on a stand.

3. A method of spray coating a plurality of mesh parts according to claim 2, wherein said step of rotatably mounting said plurality of racks comprises the steps of:

aligning bits mounted to support arms attached to each of said racks with holes in first and second plates attached to said stand; and placing said bits into said holes.

4. A method of spray coating a plurality of mesh parts according to claim 3, wherein said step of aligning bits includes the step of:

pressing said bits against an alignment tool.

5. A method of spray coating a plurality of mesh parts according to claim 3, wherein said step or arranging said plurality of mesh parts further comprises the step of:

sliding one of said support arms attached to each of said plurality of racks in grooves in said second plate.

6. A method of spray coating a plurality of racks having first and second sides, comprising the steps of:

attaching said mesh parts to a plurality of racks;

arranging said plurality of mesh parts into pairs such that the first side of each mesh part attached to a rack faces away from the corresponding rack in that pair and the second side of each mesh part faces toward the corresponding rack in that pair;

spraying said plurality of mesh parts with a coating material such that the first side of each mesh part attached to each rack in each pair is directly coated with the coating material and the second side of each mesh part attached to a rack is simultaneously coated with overspray when first side of the mesh parts attached to the corresponding rack in the pair is sprayed;

rearranging said plurality of racks into new pairs such that the second side of each mesh part attached to each rack in each pair faces away from the corresponding rack in that pair and the first side of each mesh part attached to each rack in each pair faces toward the corresponding rack in that pair;

spraying said plurality of mesh parts with a coating material such that the second side of each mesh part is directly coated with the coating material and the first side of each mesh part attached to each rack is simultaneously coated with overspray when the second side of the mesh parts attached to the corresponding rack in the pair is sprayed.

* * * * *